US005271981A

United States Patent [19]

Oxenhandler

[11] Patent Number: 5,271,981

[45] Date of Patent: Dec. 21, 1993

[54] LABELING DEVICE

[76] Inventor: Alan Oxenhandler, 800 Ivy Trace Dr., Ballwin, Mo. 63021

[21] Appl. No.: 917,763

[22] Filed: Jul. 21, 1992

[51] Int. Cl.[5] ..... G09F 3/00

[52] U.S. Cl. ..... 428/81; 428/99; 428/192; 40/316

[58] Field of Search ..... 428/81, 99, 192; 40/316

*Primary Examiner*—Alexander S. Thomas

*Attorney, Agent, or Firm*—Senniger, Powers, Leavitt & Roedel

[57] ABSTRACT

A labeling device including a generally rectangular sheet having opposite ends, transversely opposite edge margins extending between the ends, and opposite sides. The sheet is wrapped around the cable with the ends of the sheet brought together such that the sheet generally assumes the shape of a tube around the cable with a first of the sides of the sheet facing the cable and a second of the sides facing away from the cable. Interlocking tabs connect the ends of the sheet together. Fingers engaging the cable project outwardly from at least one of the edge margins of the sheet. The distal ends of the fingers are substantially fixed relative to the cable at its point of engagement therewith. The fingers are constructed to permit the tube to be moved lengthwise of the cable relative to the cable and distal ends of the fingers to a position in which they are substantially enclosed by the tube and concealed from view.

15 Claims, 2 Drawing Sheets

LABELING DEVICE

BRIEF SUMMARY OF THE INVENTION

This invention relates generally to labeling devices and more particularly to a labeling device for use in identifying electrical cables and the like.

Most cable identification systems are inadequate because they fail to meet particular individual consumer cable identification needs, which may include a variety of applications such as electronic instrumental uses (i.e., electric guitars or pianos), home audio/visual uses, recording studios and the like. For example, in many commercial applications, plastic is a common material chosen for cable identification. Plastic, whose sturdiness makes it ideal for cable tagging, must be imprinted with an expensive screen process or a cumbersome hot press process, thereby making it impractical for individual consumer usage. Also, these types of labels are usually limited by one or more of the following drawbacks. First, the tag may only be applied to a cable before the cable is terminated with an end plug. Second, the tag is generally only visible from one angle. Third, only numerical identification typically may be used, and fourth, handwriting upon the tag using an ordinary writing implement is impractical or impossible.

Accordingly, among the several objects of this invention may be noted the provision of a labeling device which is a cost-efficient alternative to an individual consumer than expensive labels more suited for commercial purposes; the provision of such a labeling device which may be secured around a cable already connected at both of its ends without disconnecting the cable from one of its ends; the provision of such a labeling device which may be read from virtually any angle; the provision of such a labeling device which can be marked with ordinary writing implements; the provision of such a labeling device which may be used on cables having a variety of diameters; and the provision of such a labeling device which is durable, simple and cost efficient in manufacture, and easy to use.

In general, a labeling device constructed according to the principles of the present invention comprises a generally rectangular sheet having opposite ends, transversely opposite edge margins extending between the ends, and opposite sides. The sheet is adapted to be wrapped around the cable with the ends of the sheet brought together such that the sheet generally assumes the shape of a tube around the cable with a first of the sides of the sheet facing the cable and a second of the sides facing away from the cable. Means connect the ends of the sheet together. Means for engaging the cable projects outwardly from at least one of the edge margins of the sheet. The engaging means is selectively movable relative to the sheet between a first position spaced from the cable to a second position in which at least a distal end of the engaging means engages the cable. The distal end of the engaging means is substantially fixed relative to the cable at its point of engagement therewith. The engaging means is constructed to permit the tube to be moved lengthwise of the cable relative to the cable and distal ends of the engaging means to a position in which the engaging means is substantially enclosed by the tube and concealed from view.

Other objects and features will be in part apparent and in part pointed out hereinafter.

BRIEF DESCRIPTION OF THE DRAWINGS

Corresponding parts are designated by corresponding reference numerals in the several views of the drawings.

DESCRIPTION OF THE PREFERRED EMBODIMENT

Figure 1:
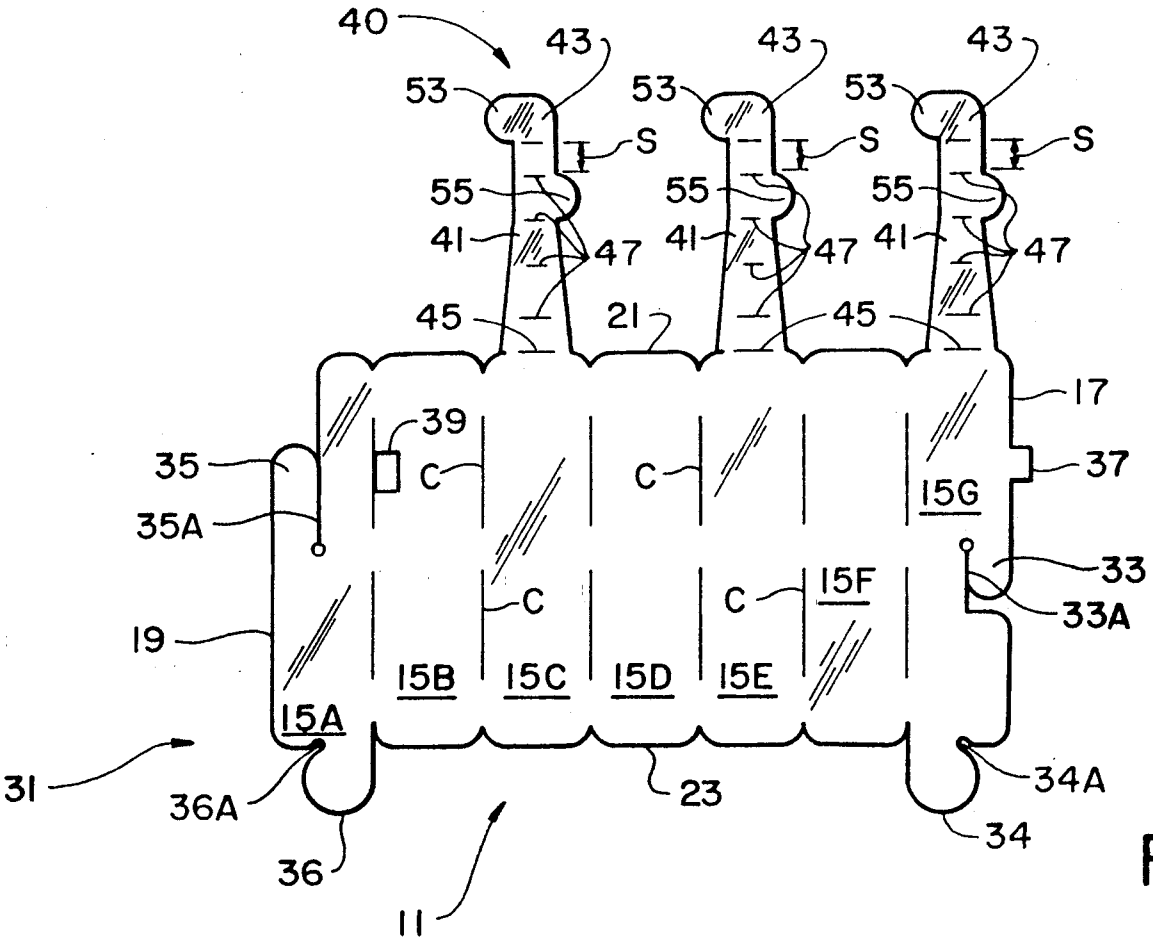
FIG. 1 is a plan of a labeling device of the present invention.

Referring now to the drawings, there is generally indicated at 11 a labeling device of the present invention for use in identifying an electrical cable 13 or the like. The labeling device 11 is stamped or die cut out of flexible and transparent sheet material such as plastic. As shown in FIG. 1, the device 11 comprises a generally rectangular sheet 15 having opposite ends 17, 19, transversely opposite edge margins 21, 23 extending between the ends, and opposite sides 25, 27. The sheet can be wrapped around the cable 13 with the ends 17, 19 of the sheet being brought together such that it generally assumes the shape of a tube around the cable with its first side 25 facing the cable and its second side 27 facing away from the cable.

The sheet 15 has a plurality of creases C extending between the opposite edge margins 21, 23. The creases C divide the sheet into 7 sections (designated 15A–15G) bendable along the creases relative to adjacent sections for facilitating wrapping of the sheet 15 around the cable. However, it is to be understood that the sheet 15 may be formed from a material which is sufficiently flexible to be wrapped around the cable without the aid of creases C. The sheet 15, as wrapped about the cable 13, has a diameter greater than the diameter of the cable.

Means for connecting the ends 17, 19 of the sheet 15 comprises in this embodiment similarly shaped, first pair of interlocking tabs 33, 35, located at each end, respectfully. More specifically, tabs 33, 35 are defined in part by slit portions (designated 33A and 35A) parallel to the creases C. After the sheet 15 is wrapped around the cable, the ends 17, 19 of the sheet are interengaged with the slit portion 33A received in the slit portion 35A so that the tab 33 overlies the laterally inner portion of the sheet section 15A and the tab overlies the laterally inner portion of the sheet portion 15G. Thus, the sheet 15 is secured in its tubular configuration without the need for fasteners. The connecting means further includes a member 37 on end 17 which projects outwardly away from the sheet generally at a right angle to the end 17, and an opening 39 adjacent the opposite end 19 of the sheet for receiving the member. After the tabs 33, 35 are interlocked, the member 37 may be inserted into the opening 39 for further insuring the connection of the ends 17, 19. Moreover, the connecting means further comprises a second pair of similarly shaped interlocking tabs 34, 36 each tab having an associated slit portion 34A, 36A, respectively. Tabs 34, 36 are interengaged with the slit portion 34A received in the slit portion 36A and portions of both tabs overlying one another.

Engaging means, indicated generally at 40, constitutes in this embodiment fingers 41 projecting laterally outwardly from edge margin 21 of the device 11 at spaced intervals between the ends 17, 19. As shown, there are three fingers 41 projecting from the top edge margin 21 at generally right angles to the edge margin. However, it is to be understood that any number of fingers may project from the top or bottom edge margin and still fall within the scope of the present invention. Moreover, the engaging means 40 may take forms other than the fingers 41 and still fall within the scope of the present invention. For instance, the engaging means could be a unitary piece (not shown) projecting from the edge margin 21 along the entire length of the edge margin. The piece would be movable relative to the sheet 15 and is stable in positions spaced from, and in engagement with the cable.

Figure 2:
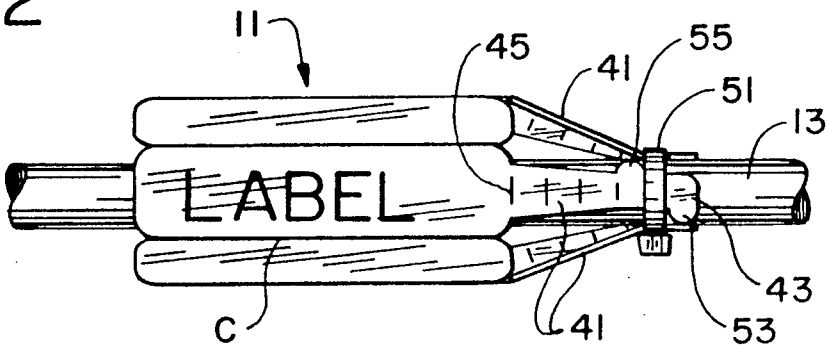
FIG. 2 is a side elevation of the labeling device wrapped about a cable, the device having fingers shown in their exposed position tied about the cable.

Each finger 41 is integral with sheet 15 and is hingedly attached to the sheet along a hinge 45 at the top edge margin 21 for swinging motion relative the sheet between a first position spaced from the cable to a second position in which a distal end 43 of the finger engages the cable (see FIG. 2). Each finger 41 has hinges 47 spaced along the length of the finger which extend in a direction transverse to the direction of the finger.

Means for securing the fingers 41 in engagement with the cable 13 comprises a self locking tie 51 which is wrapped around the cable over the distal ends 43 of the fingers when they are in their second position. Each finger 41 has two offset spaced-apart protrusions 53, 55 extending from the finger in opposite directions. Each protrusion 53, 55 extends from the finger such that when the fingers are in their second position, the protrusions extend tangent to the cable 13. A space S is provided between the protrusions 53, 55 for receiving the tie 51; the protrusions preventing the distal ends 43 of the fingers 41 from moving axially with respect to the cable 13.

Figure 3:
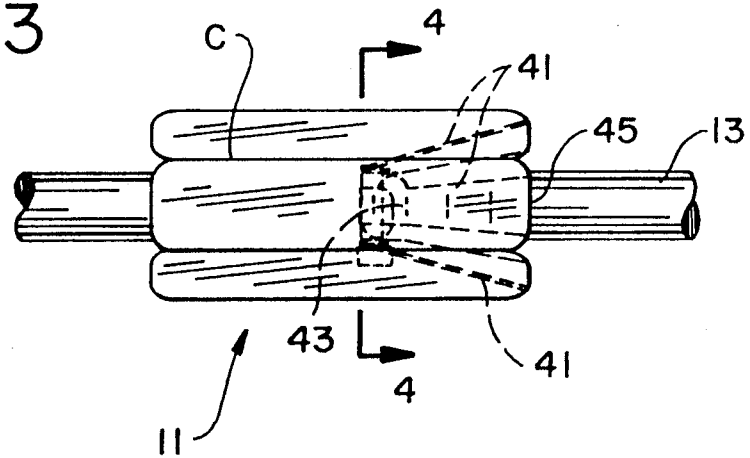
FIG. 3 is a side elevation similar to FIG. 2 with the fingers being shown in their hidden position.

The tie 51 substantially fixes the distal ends 43 of the fingers 41 to the cable 13 and thereby attaches the labeling device to the cable. The tube formed by the sheet 15 wrapped around the cable 13 is movable longitudinally of the cable relative to the distal ends 43 of the fingers 41 between a position in which the fingers and tie 51 are exposed outside the tube (FIG. 2), and a position in which the fingers and tie are concealed within the tube (FIG. 3). The movement may be accomplished because the hinges 45, 47 permit the fingers to fold upon themselves as the tube formed by the sheet 15 moves toward the distal ends 43 of the fingers and reduces the distance between the first side 25 of the sheet and the cable 13. Thus, the fingers 41 and tie 51 are hidden from view after attachment to the cable.

Figure 5:
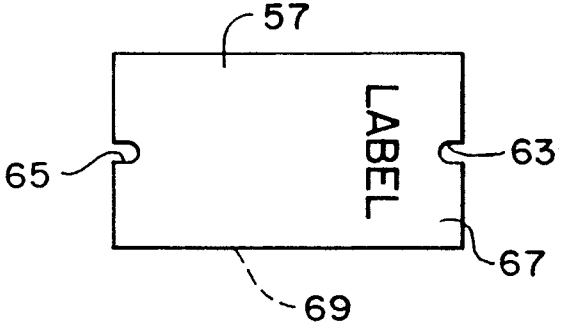
FIG. 5 is a plan of a label of the labeling device.
Figure 4:
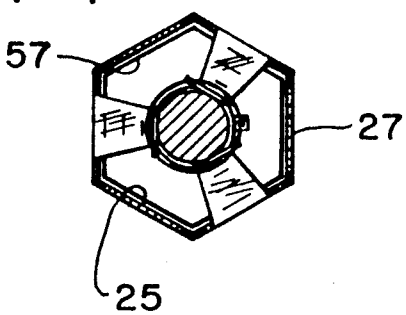
FIG. 4 is a cross-section taken along line 4—4 in FIG. 3.

The labeling device 11 further comprises means for locating a label 57 on the first side 25 of the sheet 15, such that the label may be seen through the transparent sheet. As shown in FIG. 5, the label has two slots 63, 65 located at opposite ends thereof. Each slot 63, 65 is receivable in one of the slits 33A, 35A so that the corresponding tab (33 or 35) overlies a portion of the label adjacent the slot for holding the label 57 on the sheet 15. The label 57 has two opposing writing surfaces 67, 69 on either face of the label in which information pertinent to the cable may be displayed. The label is made of a material (e.g., paper) which can be marked on with ordinary writing implements such as pens and pencils.

In use, a label 57 is superposed on the inside surface of the sheet 15, with the portions of the label received under the tabs 33, 35, so that information contained on the outside writing surface (67 or 69) of the label may be seen through the transparent outer side 27 of the sheet. The sheet 15 and the label 57 are wrapped around the cable 13 with the ends 17, 19 of the sheet being brought together to form a tube around the cable. First tabs 33, 35 are interlocked, member 37 is inserted in opening 39 and second tabs 34, 36 are interengaged to connect the ends 17, 19 of the sheet together. Fingers 41 are then moved from a first position in which they are spaced from the cable 13 to a second position in which the distal ends 43 of the fingers engage the cable. A tie 51 attaches the distal ends 43 of the fingers 41 to the cable 13. The sheet 15 is then moved lengthwise of the cable 13 relative to the secured distal ends 43 of the fingers 41. The internal diameter of the tube formed around the cable 13 by the sheet 15 is substantially larger than the cable diameter. The hinged fingers 41 allow the tube to be secured on cables of a range of diameters (e.g., $\frac{1}{8}''$ to $\frac{1}{2}''$). The fingers 41 are capable of pivoting about their respective hinges 45, 47 so that the tube formed by the sheet 15 may be moved over the fingers and tie 51 to conceal the fingers and the tie. However, the fingers 41 are left exposed when the cable exceeds approximately $\frac{3}{8}''$ in diameter.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A labeling device for use in identifying a cable-like member, the labeling device comprising:

a sheet having opposite ends, transversely opposite edge margins extending between the ends, and opposite sides, the sheet being adapted to be wrapped around the member with the ends of the sheet brought together such that the sheet generally assumes the shape of a tube around the member with a first of the sides of the sheet facing the member and a second of the sides facing away from the member;

means for connecting the ends of the sheet together;

means for engaging the member projecting outwardly from at least one of the edge margins of the sheet, said engaging means being selectively movable relative to the sheet between a first position spaced from the member to a second position in which at least a distal end of said engaging means engages the member, the distal end of said engaging means being substantially fixed relative to the member at its point of engagement therewith;

said engaging means being constructed to permit the tube to be moved lengthwise of the member relative to the member and distal ends of said engaging means to a position in which said engaging means is substantially enclosed by the tube and concealed from view.

2. A labeling device as set forth in claim 1 wherein said engaging means is adapted to change its shape between its distal end and the tube as the tube is moved longitudinally on the member.

3. A labeling device as set forth in claim 2 wherein said engaging means comprises a plurality of hinged fingers projecting outwardly from at least one of the edge margins of the sheet at intervals between the ends of the sheet.

4. A labeling device as set forth in claim 3 further comprising means for securing the distal ends of the fingers in engagement with the member.

5. A labeling device as set forth in claim 3 wherein each finger has a plurality of hinged portions permitting folding of the finger about axes extending transversely to the lengthwise extension of the finger.

6. A labeling device as set forth in claim 3 wherein each finger comprises two offset spaced-apart protrusions extending from the finger in opposite directions, such that when the fingers engage the member the protrusions extend tangent to the member.

7. A labeling device as set forth in claim 6 wherein said means for securing the fingers in engagement with the member comprises a self locking tie adapted to e wrapped around the member over the distal ends of the fingers in a position generally between the two offset spaced-apart protrusions, the protrusions being adapted to engage the tie to prevent substantial relative motion between the distal ends of the fingers and the tie.

8. A labeling device as set forth in claim 1 wherein the sheet is made from transparent material.

9. A labeling device as set forth in claim 8 further comprising a label and means for holding the label on the first side of the sheet, the label being made from a material which can be marked upon with ordinary pencil lead and ink and having at least one slot therein, said holding means comprising at least one tab integral with the sheet, the tab being adapted for reception in the slot to secure the label to the sheet.

10. A labeling device for use in identifying cable-like member, the labeling device comprising:

a sheet having opposite ends, transversely opposite edge margins extending between the ends, and opposite sides, the sheet being adapted to be wrapped around the member with the ends of the sheet brought together such that the sheet generally assumes the shape of a tube around the member with a first of the sides of the sheet facing the member and a second of the sides facing away from the member;

means for connecting the ends of the sheet together;

a plurality of hinged fingers projecting outwardly from at least one of the edge margins of the sheet at intervals between the ends of the sheet, the fingers means being selectively pivotable relative to the sheet between a first position spaced from the member and a second position in which at least distal ends of the fingers engage the member;

means for fixing the distal ends of the fingers in engagement with the member;

the fingers being constructed for folding about their hinges to permit the tube to be moved lengthwise of the member relative to the member and distal ends of the fingers to a position in which the fingers are substantially enclosed by the tube and concealed from view.

11. A labeling device as set forth in claim 10 wherein each finger has a plurality of hinged portions permitting folding of the finger about axes extending transversely to the lengthwise extension of the finger.

12. A labeling device as set forth in claim 10 wherein each finger comprises two offset spaced-apart protrusions extending from the finger in opposite directions, such that when the fingers engage the member the protrusions extend tangent to the member.

13. A labeling device as set forth in claim 12 wherein said means for securing the fingers in engagement with the member comprises a self locking tie adapted to be wrapped around the member over the distal ends of the fingers in a position generally between the two offset spaced-apart protrusions, the protrusions being adapted to engage the tie to prevent substantial relative motion between the distal ends of the fingers and the tie.

14. A labeling device as set forth in claim 10 wherein the sheet is made from transparent material.

15. A labeling device as set forth in claim 14 further comprising a label and means for holding the label on the first side of the sheet, the label being made from a material which can be marked upon with ordinary pencil lead and ink and having at least one slot therein, said holding means comprising at least one tab integral with the sheet, the tab being adapted for reception in the slot to secure the label to the sheet.

* * * * *